US012297707B2

(12) United States Patent
Shen et al.

(10) Patent No.: US 12,297,707 B2
(45) Date of Patent: May 13, 2025

(54) LATCH ASSEMBLY

(71) Applicant: Schlumberger Technology Corporation, Sugar Land, TX (US)

(72) Inventors: Christopher Shen, Richmond, TX (US); Christopher Cassidy, Pearland, TX (US); Julia Huynh, Houston, TX (US); Valeria Erives, Houston, TX (US); Harshith Dmello, Rosharon, TX (US); Ronnie Bruce, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/553,902

(22) PCT Filed: Apr. 7, 2022

(86) PCT No.: PCT/US2022/023838
§ 371 (c)(1),
(2) Date: Oct. 4, 2023

(87) PCT Pub. No.: WO2022/216933
PCT Pub. Date: Oct. 13, 2022

(65) Prior Publication Data

US 2024/0191585 A1 Jun. 13, 2024

Related U.S. Application Data

(60) Provisional application No. 63/267,584, filed on Feb. 4, 2022, provisional application No. 63/171,625, filed on Apr. 7, 2021.

(51) Int. Cl.
*E21B 23/02* (2006.01)
*E21B 17/06* (2006.01)
(Continued)

(52) U.S. Cl.
CPC ..... *E21B 23/06* (2013.01); *E21B 17/06* (2013.01); *E21B 23/02* (2013.01); *E21B 33/12* (2013.01)

(58) Field of Classification Search
CPC ..... E21B 23/02; E21B 23/06; E21B 17/06
See application file for complete search history.

(56) References Cited

U.S. PATENT DOCUMENTS 4,039,208 A 8/1977 Pernet
4,570,707 A 2/1986 Setterberg, Jr.
(Continued)

FOREIGN PATENT DOCUMENTS

EP 1212510 A1 6/2002
EP 1251598 A1 10/2002
(Continued)

OTHER PUBLICATIONS

International Search Report and Written Opinion of International Patent Application No. PCT/US2021/059923 dated Mar. 11, 2022, 11 pages.

(Continued)

*Primary Examiner* — Giovanna Wright
(74) *Attorney, Agent, or Firm* — Jeffrey D. Frantz

(57) ABSTRACT

A lock latch assembly for a multi-stage completion and method of operating the lock latch assembly are provided. The latch assembly functions as a snap latch prior to activation and as a shear latch after activation.

13 Claims, 21 Drawing Sheets

(51) Int. Cl.
*E21B 23/06* (2006.01)
*E21B 33/12* (2006.01)

(56) References Cited

U.S. PATENT DOCUMENTS

| | | | | |
|---|---|---|---|---|
| 4,682,848 | A | 7/1987 | Cairns | |
| 5,066,060 | A * | 11/1991 | Cooksey | E21B 17/06 294/86.18 |
| 5,197,546 | A | 3/1993 | Murray | |
| 5,577,925 | A | 11/1996 | Schnatzmeyer | |
| 5,838,857 | A | 11/1998 | Niekrasz | |
| 6,131,663 | A | 10/2000 | Henley | |
| 6,152,608 | A | 11/2000 | Ghara | |
| 6,186,229 | B1 | 2/2001 | Martin | |
| 6,349,767 | B2 | 2/2002 | Gissler | |
| 6,390,193 | B1 | 5/2002 | Martin | |
| 6,510,899 | B1 | 1/2003 | Sheiretov et al. | |
| 6,511,335 | B1 | 1/2003 | Rayssiguier | |
| 6,568,481 | B2 | 5/2003 | Koehler | |
| 6,571,046 | B1 | 5/2003 | Hickey | |
| 6,668,921 | B2 | 12/2003 | Koehler | |
| 6,776,636 | B1 | 8/2004 | Cameron | |
| 6,929,404 | B2 | 8/2005 | Jones | |
| 6,983,796 | B2 | 1/2006 | Bayne | |
| 7,165,892 | B2 | 1/2007 | Grigsby | |
| 7,191,832 | B2 | 3/2007 | Grigsby | |
| 7,228,898 | B2 | 6/2007 | Grigsby | |
| 7,252,437 | B2 | 8/2007 | Ringgenberg | |
| 7,398,822 | B2 | 7/2008 | Meijer | |
| 7,475,734 | B2 | 1/2009 | O'Malley et al. | |
| 7,487,830 | B2 | 2/2009 | Wolters | |
| 7,503,395 | B2 | 3/2009 | Meijer et al. | |
| 7,509,000 | B2 | 3/2009 | Coronado | |
| 7,510,003 | B2 | 3/2009 | Meijer | |
| 7,556,093 | B2 | 7/2009 | Grigsby | |
| 7,594,763 | B2 | 9/2009 | Richards | |
| 7,607,477 | B2 | 10/2009 | Stoesz | |
| 7,611,290 | B2 | 11/2009 | Ringgenberg | |
| 7,628,543 | B2 | 12/2009 | Coronado | |
| 7,640,977 | B2 | 1/2010 | Jonas | |
| 7,644,755 | B2 | 1/2010 | Stoesz | |
| 7,736,067 | B2 | 6/2010 | Read | |
| 7,798,212 | B2 | 9/2010 | Bolze et al. | |
| 7,806,190 | B2 | 10/2010 | Du | |
| 7,900,698 | B2 | 3/2011 | Stoesz | |
| 8,061,429 | B2 | 11/2011 | Du | |
| 8,061,430 | B2 | 11/2011 | Du | |
| 8,082,990 | B2 | 12/2011 | Lovell | |
| 8,113,290 | B2 | 2/2012 | Sharma | |
| 8,496,064 | B2 | 7/2013 | Du | |
| 8,550,175 | B2 | 10/2013 | Shafiq | |
| 8,596,348 | B2 | 12/2013 | Brookbank | |
| 8,752,635 | B2 | 6/2014 | Wang | |
| 8,794,337 | B2 | 8/2014 | Thomas | |
| 8,839,850 | B2 | 9/2014 | Algeroy | |
| 8,936,078 | B2 | 1/2015 | Richards | |
| 9,157,561 | B2 | 10/2015 | Martin | |
| 9,270,051 | B1 | 2/2016 | Christiansen | |
| 9,404,314 | B2 | 8/2016 | Perez | |
| 9,500,071 | B2 | 11/2016 | Morgan-Smith | |
| 9,523,243 | B2 | 12/2016 | Richards | |
| 9,627,798 | B2 | 4/2017 | Plant | |
| 9,683,412 | B2 | 6/2017 | Richards | |
| 9,759,016 | B2 | 9/2017 | Perez | |
| 9,850,720 | B2 | 12/2017 | Richards | |
| 9,915,104 | B2 | 3/2018 | Richards | |
| 9,945,203 | B2 | 4/2018 | Patel | |
| 9,988,894 | B1 | 6/2018 | Malone | |
| 10,000,995 | B2 | 6/2018 | Bishop | |
| 10,060,196 | B2 | 8/2018 | Richards | |
| 10,113,371 | B2 | 10/2018 | Richards | |
| 10,267,097 | B2 | 4/2019 | Mendez | |
| 10,329,855 | B2 | 6/2019 | Brady | |
| 10,329,871 | B2 | 6/2019 | King | |
| 10,352,110 | B2 | 7/2019 | Olin | |
| 10,502,003 | B2 | 12/2019 | Johnson | |
| 10,619,424 | B2 | 4/2020 | Loh | |
| 10,934,785 | B2 | 3/2021 | Fripp | |
| 11,162,306 | B2 | 11/2021 | Simonsen | |
| 11,193,339 | B2 | 12/2021 | El Mallawany | |
| 11,646,526 | B2 | 5/2023 | Burrow | |
| 2003/0211768 | A1 | 11/2003 | Cameron | |
| 2005/0072564 | A1 | 4/2005 | Grigsby | |
| 2006/0086508 | A1 | 4/2006 | Coon | |
| 2006/0243450 | A1 | 11/2006 | Head | |
| 2006/0243454 | A1 | 11/2006 | Bolze et al. | |
| 2006/0260803 | A1 | 11/2006 | Meijer et al. | |
| 2008/0029274 | A1 | 2/2008 | Rytlewski | |
| 2008/0223585 | A1 | 9/2008 | Patel | |
| 2009/0045146 | A1 | 2/2009 | Stoesz | |
| 2009/0321069 | A1 | 12/2009 | Jonas | |
| 2010/0314109 | A1 | 12/2010 | Garcia et al. | |
| 2011/0192596 | A1 | 8/2011 | Patel | |
| 2012/0168178 | A1* | 7/2012 | Eriksen | E21B 23/04 166/123 |
| 2013/0048307 | A1 | 2/2013 | Patel | |
| 2013/0153203 | A1* | 6/2013 | Lauderdale | E21B 17/06 166/55 |
| 2013/0153207 | A1* | 6/2013 | Lauderdale | E21B 17/07 166/123 |
| 2013/0306316 | A1 | 11/2013 | Patel | |
| 2013/0319685 | A1 | 12/2013 | Pike | |
| 2013/0327546 | A1 | 12/2013 | Rytlewski | |
| 2014/0352793 | A1 | 12/2014 | Martin et al. | |
| 2015/0368983 | A1 | 12/2015 | Perez et al. | |
| 2015/0376956 | A1 | 12/2015 | Richards | |
| 2016/0006161 | A1 | 1/2016 | Ranalli | |
| 2016/0273290 | A1* | 9/2016 | Harms | E21B 17/046 |
| 2016/0356095 | A1 | 12/2016 | Perez | |
| 2017/0044843 | A1 | 2/2017 | Hanton | |
| 2017/0357051 | A1 | 12/2017 | Bulu | |
| 2019/0153788 | A1* | 5/2019 | El Mallawany | E21B 23/042 |
| 2020/0080398 | A1 | 3/2020 | Loh | |
| 2021/0032940 | A1 | 2/2021 | Simonsen | |
| 2022/0081993 | A1* | 3/2022 | Chevallier | E21B 34/142 |
| 2022/0081994 | A1* | 3/2022 | Chevallier | E21B 34/14 |

FOREIGN PATENT DOCUMENTS

| | | | |
|---|---|---|---|
| GC | 2881 | A | 9/2014 |
| WO | 2004079151 | A2 | 9/2004 |
| WO | 2014089132 | A1 | 6/2014 |
| WO | 2015060817 | A1 | 4/2015 |
| WO | 2015044208 | A3 | 6/2015 |
| WO | 2017105434 | A1 | 6/2017 |
| WO | 2017213726 | A2 | 12/2017 |
| WO | 2020087001 | A1 | 4/2020 |
| WO | 2021247726 | A1 | 12/2021 |
| WO | 2022109157 | A1 | 5/2022 |
| WO | 2022192669 | A1 | 9/2022 |

OTHER PUBLICATIONS

"Control Line Wet Mate (CLWM) Connector", product sheet downloaded from [https://www.slb.com/-/media/files/co/product-sheet/control-line-wet-mate-ps.ashx] on Jun. 29, 2022, 2 pages.

"HLWM Hydraulic-line downhole wet-mate connector", product sheet downloaded from [https://www.slb.com/-/media/files/co/product-sheet/hlwm-ps.ashx] downloaded on Jun. 29, 2022, 2 pages.

"HEWM Hydraulic and electric downhole wet-mate connector" product sheet downloaded from [https://www.slb.com/-/media/files/co/product-sheet/hewm-ps.ashx] downloaded on Jun. 29, 2022, 2 pages.

B.K. Drakeley et al, 2014, "Integration into the Sandface Tool System for Gravel and Frack-Pack Installations with a Fiber Optics Wet-Mate Connector System", OTC-25195-MS, Offshore Technology Conference, held in Houston, Texas, USA, May 5-8, 2014 (15 pages).

International Search Report and Written Opinion of International Patent Application No. PCT/US2022/019952 dated Jun. 20, 2022, 10 pages.

(56) References Cited

OTHER PUBLICATIONS

International Search Report and Written Opinion of International Patent Application No. PCT/US2022/023838 dated Jul. 26, 2022, 12 pages.
"SureCONNECT Downhole Intelligent Wet-Mate System", downloaded on May 21, 2023 from link https://www.bakerhughes.com/completions/well-monitoring-and-analytics/sureconnect-downhole-intelligent-wetmate-system (8 pages).
"Quantum Snap Latch Assembly", (2014) SLB product sheet, downloaded on May 21, 2023, from link https://www.bing.com/searchq=QUANTUM+Snap+Latch+Assembly search= pc=U522 form=CHRDEF, (1 page).
"QUANTUM Anchor Latch Assembly", (2014) SLB product sheet, downloaded on May 21, 2023 from link https://www.bing.com/searchq=QUANTUM+Anchor+Latch+Assembly qs=n form=QBRE sp=-1 ghc=1 lq=0 pq=quantum+anchor+latch+assembly sc=6-29 sk= cvid=C6BC1C74AC8C44EC9D227795D68F1DD9 ghsh=0 ghacc=0 ghpl= (1 page).
"Quantum Shear-Type Anchor Latch" (2014), SLB product sheet, downloaded on May 21, 2023, from link https://www.bing.com/searchq=QUANTUM+Shear-Type+Anchor+Latch qs=n form=QBRE sp=-1 ghc=1 lq=0 pq=quantum+shear-type+anchor+latch sc=6-31 sk= cvid=A2F41C06C6DB44198EEFF506C1CB5DFB ghsh=0 ghacc=0 ghpl= (1 page).
International Search Report and Written Opinion issued in the PCT Application PCT/US2021/035478, dated Nov. 12, 2021 (12 pages).
Combined Search and Exam Report issued in United Kingdom Patent Application No. GB2410487.9 dated Jul. 29, 2024, 2 pages.
Office Action issued in U.S. Appl. No. 18/548,945 dated Aug. 9, 2024, 24 pages.

* cited by examiner

LATCH ASSEMBLY

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a National Stage of International Application No. PCT/US2022/023838, filed Apr. 7, 2022, which claims priority benefit of U.S. Provisional Application Nos. 63/171,625, filed Apr. 7, 2021, and 63/267,584, filed Feb. 4, 2022, the entirety of each of which is incorporated by reference herein and should be considered part of this specification.

BACKGROUND

Field

The present disclosure generally relates to a latch assembly, which may be used in various equipment for use in oil and gas wells.

Description of the Related Art

Many types of wells, e.g., oil and gas wells, are completed in multiple stages. For example, a lower stage of the completion, or lower completion assembly, is moved downhole on a running string. After deployment of the lower completion assembly at a desired location in the wellbore, an upper stage of the completion, or upper completion assembly, is deployed downhole and engaged with the lower completion assembly. In various single and multi-stage completions, latch assemblies may be used, for example, to verify location at a target depth.

SUMMARY

In some configurations, a lock latch assembly includes a body; a mandrel disposed circumferentially within the body; a top sub coupled to an upper end of the mandrel; a sliding collar disposed about a portion of the body and a portion of the top sub; a locking collet disposed circumferentially within a portion of the body; a sliding cage disposed circumferentially within the locking collet; one or more shear screws extending radially through the body; and a preventer collet disposed about a portion of the body and comprising a tab portion disposed axially between the top sub and the body when the lock latch assembly is in a run-in-hole position.

The lock latch assembly can further include an activation collet disposed about a portion of the body. The lock latch assembly can be configured to allow for bypass of one or more control lines.

In some configurations, a method of locking the lock latch assembly includes shouldering the sliding collar with a topmost face of a packer disposed in a wellbore; and applying a downward or compressive force, thereby causing the sliding collar to move upwards and the locking collet to contact the packer.

The method can further include activating the lock inside the packer. Activating the lock can include applying a high compressive force, shearing the shear screws; and sliding the sliding cage under the locking collet to maintain the locking collet in engagement with the packer. The method can further include releasing the lock latch assembly by applying a high tension force. Releasing the lock latch assembly can include pulling the mandrel upward, thereby sliding the sliding cage upward and allowing the locking collet to deflect out of engagement with the packer.

In some configurations, a latch lock assembly is configured to function as a snap latch prior to activation and configured to act as a shear latch after activation.

In some configurations, a method of operating a latch assembly includes running the latch assembly in hole; applying a light compressive force to achieve stab-in of the latch assembly with a packer; and activating the latch assembly by applying a compressive force greater than the light compressive force.

The method can include operating the latch assembly as a snap latch after stab-in and prior to activation. The method can include operating the latch assembly as a shear latch after activation. The method can include releasing the latch assembly by applying a high tension force. The method can include lifting the latch assembly out of hole by applying a tension force less than the high tension force.

In some configurations, a latch assembly includes a main housing; a mandrel disposed at least partially circumferentially within the main housing; a top sub coupled to an upper end of the mandrel; a sliding collar disposed circumferentially about the top sub and the main housing; a slotted sub disposed circumferentially about a lower portion of the mandrel; and a locking collet disposed circumferentially about the slotted sub, an outer surface of the locking collet comprising teeth configured to engage corresponding grooves in a packer.

The latch assembly can include a sliding cage disposed radially outward of the slotted sub and coupled to the mandrel, and a retainer disposed circumferentially about the slotted sub. The retainer can include an inwardly projecting engagement feature and the sliding cage can include a groove. During installation of the latch assembly, a compressive force on the latch can cause the top sub, mandrel, and sliding cage to move downward until the engagement feature snaps into the groove of the sliding cage. A light tension on the latch can ensure engagement of the teeth of the locking collet with the grooves in the packer. The engagement feature can be configured to be sheared by a large tension on the latch to release the latch and allow the latch to be removed. The latch assembly can include a hole formed in the main housing and configured to allow one or more control lines to extend through the latch assembly.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
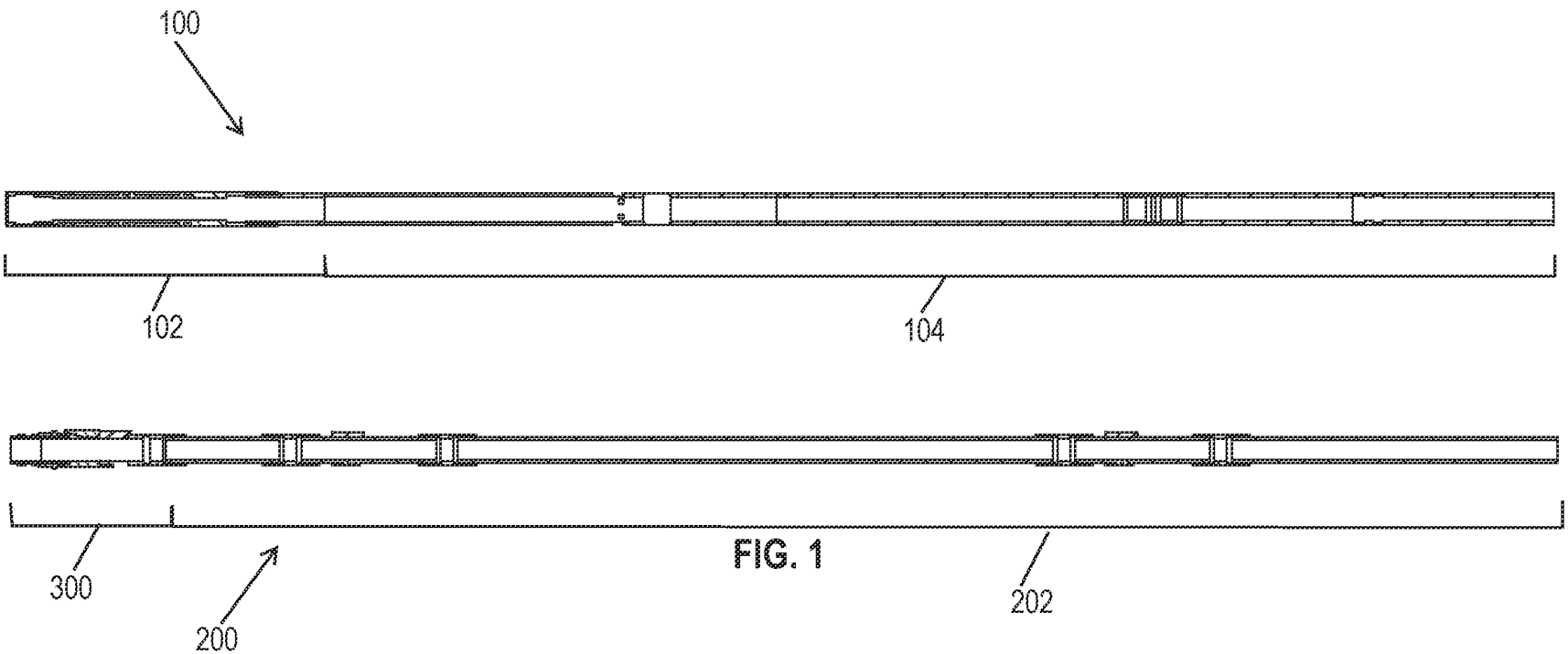
FIG. 1 illustrates a lower completion and an upper completion of an example two-stage completion.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Various latch assemblies, such as snap latch assemblies and shear latch assemblies, are used in oil and gas wells, for example during gravel pack operations to verify location at a target depth. Latches are safety devices used to prevent unwanted disconnection in a production string. A latch can be attached to a tool above the latch in the string, and a connection point is provided in the string below the latch. The latch provides adequate holding force to the part of the string where it is located, and provides a point of securement for the string at that position. Latches are often used at several strategic locations along the production string. Snap latches typically include a support to force teeth (for example, on a collet) into corresponding grooves for connection. The support is removed or displaced to allow for disconnection. Snap latches may be able to connect and disconnect multiple times. Shear latches typically rely on simply a tight fit between the teeth and grooves. For disconnection, a high amount of force shears the teeth.

Many types of wells, e.g., oil and gas wells, are completed in multiple stages. For example, a lower stage of the completion, or lower completion assembly, is moved downhole on a running string. After deployment of the lower completion assembly at a desired location in the wellbore, an upper stage of the completion, or upper completion assembly, is deployed downhole and engaged with the lower completion assembly. As used herein, "lower" can refer to a first or lead equipment/assembly moved downhole. "Upper" can refer to a second or later equipment/assembly moved downhole into engagement with the lower unit. In a horizontal wellbore, for example, the lower equipment/assembly is run downhole first prior to the upper equipment/assembly.

Many well completions incorporate one or more control lines, such as optical, electrical, and/or hydraulic control lines, to carry signals to or from components of the downhole completion. For example, in many applications, it is desirable to instrument the lower completion with electrical or optical sensors or to provide for transmission of fluids to devices in the lower completion. To enable communication of signals between the sensor(s) in the lower completion and the surface or seabed, a wet-mate connection is needed between the upper and lower completion equipment.

The upper and lower completion assemblies can include a variety of components and assemblies for multistage well operations, including completion assemblies, drilling assemblies, well testing assemblies, well intervention assemblies, production assemblies, and other assemblies used in various well operations. The upper and lower assemblies can include a variety of components depending on the application, including tubing, casing, liner hangers, formation isolation valves, safety valves, other well flow/control valves, perforating and other formation fracturing tools, well sealing elements, e.g., packers, polish bore receptacles, sand control components, e.g., sand screens and gravel packing tools, artificial lift mechanisms, e.g., electric submersible pumps or other pumps/gas lift valves and related accessories, drilling tools, bottom hole assemblies, diverter tools, running tools and other downhole components.

An example two-stage completion, for example as shown in FIG. 1, includes an upper completion 200 and a lower completion 100. As shown in FIG. 1, the lower completion 100 can include a packer 102 and a gravel pack extension 104. The upper completion 200 can include a latch assembly 300 and one or more seal units 202. In use, the upper completion 200 is run inside the lower completion 100 until the latch assembly 300 shoulders on the packer 102.

In some configurations, a latch assembly 300 according to the present disclosure can be used in a two-stage completion including a downhole wetmate system to establish communication (e.g., electrical, optical, and/or hydraulic communication) between the upper completion 200 and the lower completion 100. The upper completion 200, for example, a stinger, can include one or more upper wetmate connectors, and the lower completion 100, for example, a receptacle, can include one or more lower wetmate connectors. In use, the upper completion 200 is run in hole until the stinger fully engages the receptacle. The upper wetmate connectors are then mated with the lower wetmate connectors. Latch assemblies 300 according to the present disclosure can also or alternatively be used in various single or multi-stage completions that may not include a wetmate system.

In a multi-stage completion, once the lower 100 and upper 200 completions are installed and connected, the latch assembly 300 acts as a snap latch and the user can snap out and back in numerous times as a method to verify their position downhole. After the position has been verified, there are applications, for example, when used with a wetmate connection, in which it is critical that the upper completion 200 remains locked in place, e.g., relative to the lower completion 100, to ensure the integrity of the upper completion 200. The present disclosure provides a lock latch assembly 300 configured to secure the upper completion 200 in place during operation and prevent or inhibit involuntary disengagement. In some configurations, in use, the lock latch assembly 300 requires a low latching force and functionally operates similarly to a snap latch assembly until activated. The lock latch assembly 300 may then function similarly to a shear-type latch after activation and require a much higher overpull to release the system.

The latching mechanism advantageously allows the system to latch with a single movement downwards. During installation when the latch assembly 300 shoulders on the packer 102, only a small to moderate force is required to disengage the lock latch 300 from the packer 102. Once the upper completion 200 is ready to be locked inside the lower completion 100, the lock latch 300 is activated. Lock latch 300 activation can be achieved or facilitated by, for example, a compressive force, hydraulic pressure, hydrostatically, or electronically. To release the lock, an excessive or higher overpull is required to disengage the lock via an internal shear device. The upper completion 200 may include other assemblies (e.g., contraction joints) that might require an overpull for activation. The lock latch assembly 300 of the current disclosure requires a higher overpull than such other assemblies, advantageously preventing or inhibiting premature disengagement of the system, for example, when activating other assemblies.

Figure 2:
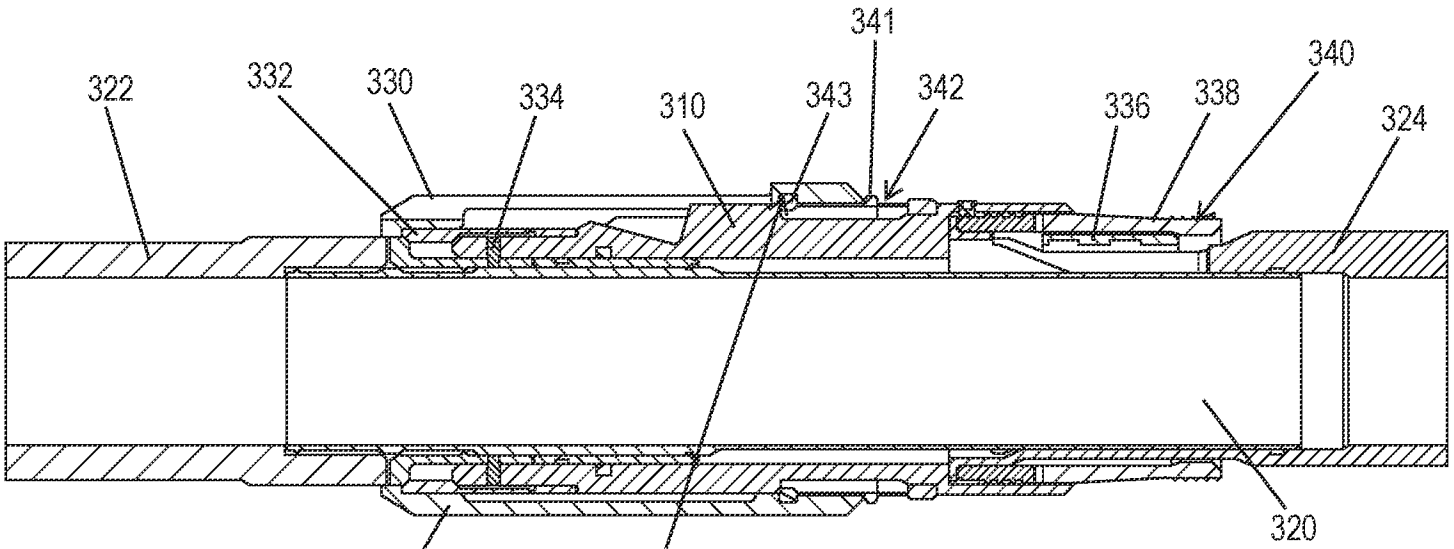
FIG. 2 illustrates an example lock latch assembly for use with a multi-stage completion.

FIG. 2 illustrates an example lock latch or latch assembly 300 according to the present disclosure. The latch assembly 300 includes a main housing or body 310, a mandrel or center tube 320, a top sub 322, and a slotted sub 324. The mandrel 320 extends circumferentially within and through the main housing 310. The top sub 322 is coupled to an upper end of the mandrel 320. In the illustrated embodiment, a bottom portion of the top sub 322 is circumferentially disposed about a top portion of the mandrel 320. The slotted sub 324 is circumferentially disposed about a bottom portion of the mandrel 320 and extends below the mandrel 320. A bottom sub can be coupled to a lower end of the slotted sub 324. For example, an upper portion of the bottom sub can be circumferentially disposed about a bottom portion of the slotted sub 324.

A sliding collar 330 is circumferentially disposed about a portion of the main housing 310 and a portion of the mandrel 320. A preventer collet 332 is partially disposed radially or circumferentially between the main housing 310 and the sliding collar 330. As shown, a portion of the preventer collet 332 including a tab is disposed circumferentially or radially between the mandrel 320 and the sliding collar 330. The tabbed portion can extend into an axial gap between the top sub 322 and the main housing 310. One or more shear screws 334 couple the main housing 310 to the mandrel 320.

A sliding cage or lock collar 336 is disposed radially outside the slotted sub 324. The sliding cage 336 is coupled to the mandrel 320. For example, raised profiles or extending features may pass through the slotted sub 324 to connect the sliding cage 336 to the mandrel 320. In some configurations, the raised profiles or features extend from the sliding cage 336, through slots in the slotted sub 324, into contact and/or engagement with the mandrel 320. Alternatively, raised profiles or features can extend from the mandrel 320, through the slots in the slotted sub 324, and into contact and/or engagement with the sliding cage 336. A locking collet 338 is disposed radially or circumferentially about the slotted sub 324 and the sliding cage 336. The sliding cage 336 is therefore disposed radially between the locking collet 338 and the slotted sub 324. An outer surface or circumference of the locking collet 338, for example proximate a lower end of the locking collet 338, includes teeth 340. In the illustrated configuration, a lower portion of the main housing 310 is disposed circumferentially about an upper portion of the locking collet 338. An activation collet 342 is disposed circumferentially about a portion of the main housing 310.

The latch assembly 300 is activated via compressive force. To prevent premature activation caused by set down weight when running in hole, the sliding collar 330 holds the tab of the preventer collet 332 in the axial gap between the top sub 322 and the main housing 310 and prevents the preventer collet 332 from flexing outward. The tab of the preventer collet 332 and/or the shear screws 334 prevent the top sub 322 from moving downwards into contact with the main housing 310. The sliding collar 330 is in turn held or locked in place by the activation collet 342. In some configurations, the activation collet 342 includes a tab 343 that interacts with a corresponding recess 331 in the sliding collar 330 to hold the sliding collar 330 in place. The latch assembly 300 is therefore held in the position shown in FIG. 2 during run in hole.

Figure 3:
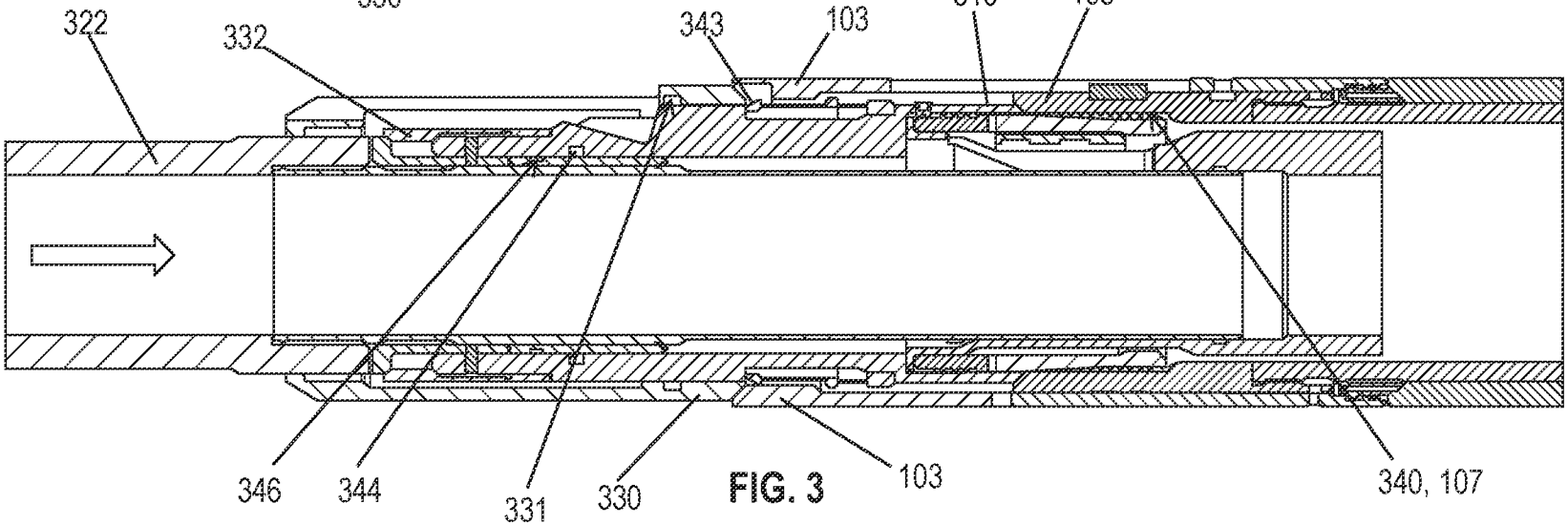
FIG. 3 illustrates the example lock latch assembly of FIG. 2 with an engaged latch collet.

During installation, the latch stabs into the lower completion 100, for example the packer 102. The packer, for example, a setting sleeve 103 (shown in FIG. 3) of the packer 102, contacts the activation collet 342, for example, a raised profile 341 of the activation collet 342. The setting sleeve 103 contacting and passing over the raised profile 341 deflects the activation collet 342, for example, deflecting the tab 343 of the activation collet 342 out of the recess 331 of the sliding collar 330. As the latch 300 continues to move downward, the sliding collar 330 shoulders with the packer 102 or setting sleeve 103. With the sliding collar 330 released from the activation collet 342, further downward movement or small compressive force causes the sliding collar 330 to be pushed upward by the packer 102, for example as shown in FIG. 3.

As the sliding collar 330 slides upward relative to the top sub 322, mandrel 320, and main housing 310, the sliding collar 330 no longer restricts outward flexing of the preventer collet 332. A lower or bottom surface of the main housing 310 contacts the packer 102, for example, a top sub 105 of the packer 102, as also shown in FIG. 3. The teeth 340 of the locking collet 338 may contact or engage corresponding teeth 107 on an inner surface or circumference of the top sub 105 of the packer 102. Contact of the main housing 310 with the top sub 105 stops further movement of the latch, and stab-in is complete. Stabbing into the packer may require a relative low amount of compressive force on the latch, for example, about 5 kips. At this stage, the latch 300 is able to disengage with a moderate amount of tensile force. The latch 300 therefore can function as a snap latch at this stage, and the locking collet 338 can disengage by means of a low-to-moderate tensile force. The preventer collet 332 is no longer supported by the sliding collar 330, but lock activation is prevented by the shear screws 334.

Figure 4:
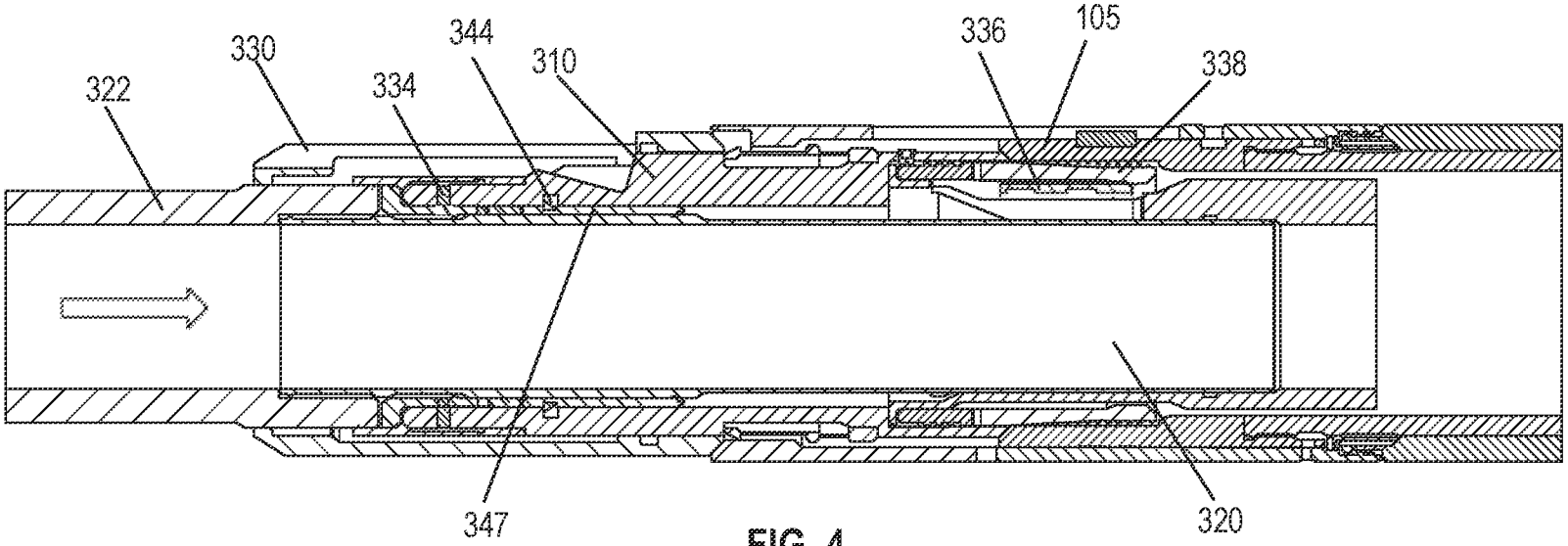
FIG. 4 illustrates the example lock latch assembly of FIG. 2 with the latch collet locked.

To activate the lock latch 300 or engage the locking functionality, a higher compressive force is applied, for example, about 30 kips, as shown in FIG. 4. The compression moves the top sub 322 and mandrel 320 downward relative to the main housing 310, thereby shearing the shear screws 334. The preventer collet 332 flexes outward, and the axial gap between the top sub 322 and the main housing 310 closes as the top sub moves downward. The preventer collet 332 may flex outward into an undercut or recess in the sliding collar 330 such that the tab of the preventer collet 332 is no longer disposed axially between the top sub 322 and the main housing 310. As the mandrel 320 moves down (or to the right in the orientation of the figures), the sliding cage 336 moves with the mandrel 320. The sliding cage 336 slides under the locking collet 338 to support the locking collet 338 and prevent inward deflection of the locking collet 338. This can hold teeth 340 of the locking collet 338 in engagement with the teeth 107 of the packer 102.

In some configurations, a snap ring 344 is disposed radially between the main housing 310 and the mandrel 320. To retain the position of the mandrel 320 and the sliding cage's 336 support of the locking collet 338, the snap ring 344 engages a corresponding groove 346 in or attached to the mandrel 320. In some configurations, the groove is formed in a component 347 disposed radially between the mandrel 320 and the main housing 310. In some configurations, a shear ring 348 fixes the component 347 to the mandrel 320. The engagement of the snap ring 344 in the groove 346 fixes the component 347 to the main housing 310. The main housing 310 is therefore coupled to the mandrel 320 by the snap ring 344 and the shear ring 348.

Figure 5:
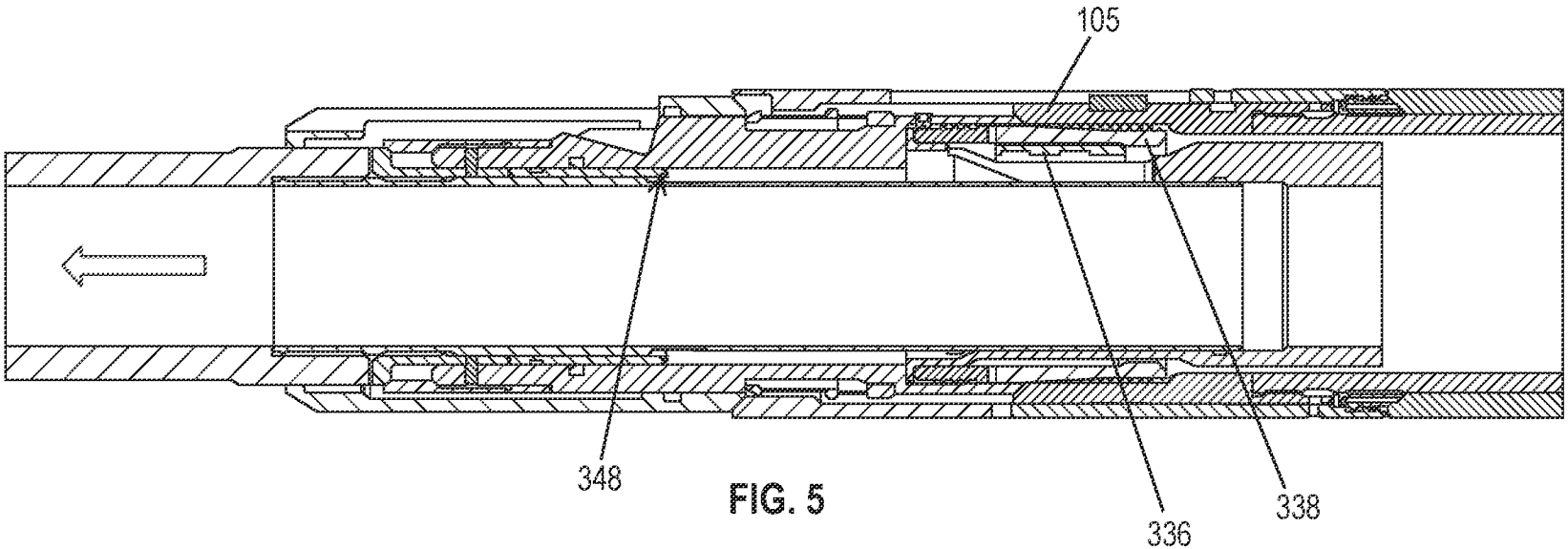
FIG. 5 illustrates the example lock latch assembly of FIG. 2 with the latch collet unlocked.

The locking activation can also or alternatively be facilitated or accomplished hydraulically, hydrostatically or electrically. To release the latch collet and the lock assembly, a high overpull is applied, as shown in FIG. 5. The high overpull can shear the shear ring 348, thereby allowing the mandrel 320 to move up relative to the main housing 310, thereby also moving the sliding cage 336 such that the sliding cage 336 no longer supports the locking collet 338, as shown in FIG. 5. This allows the locking collet 338 to deflect inward, for example, similar to a snap latch.

Figure 6:
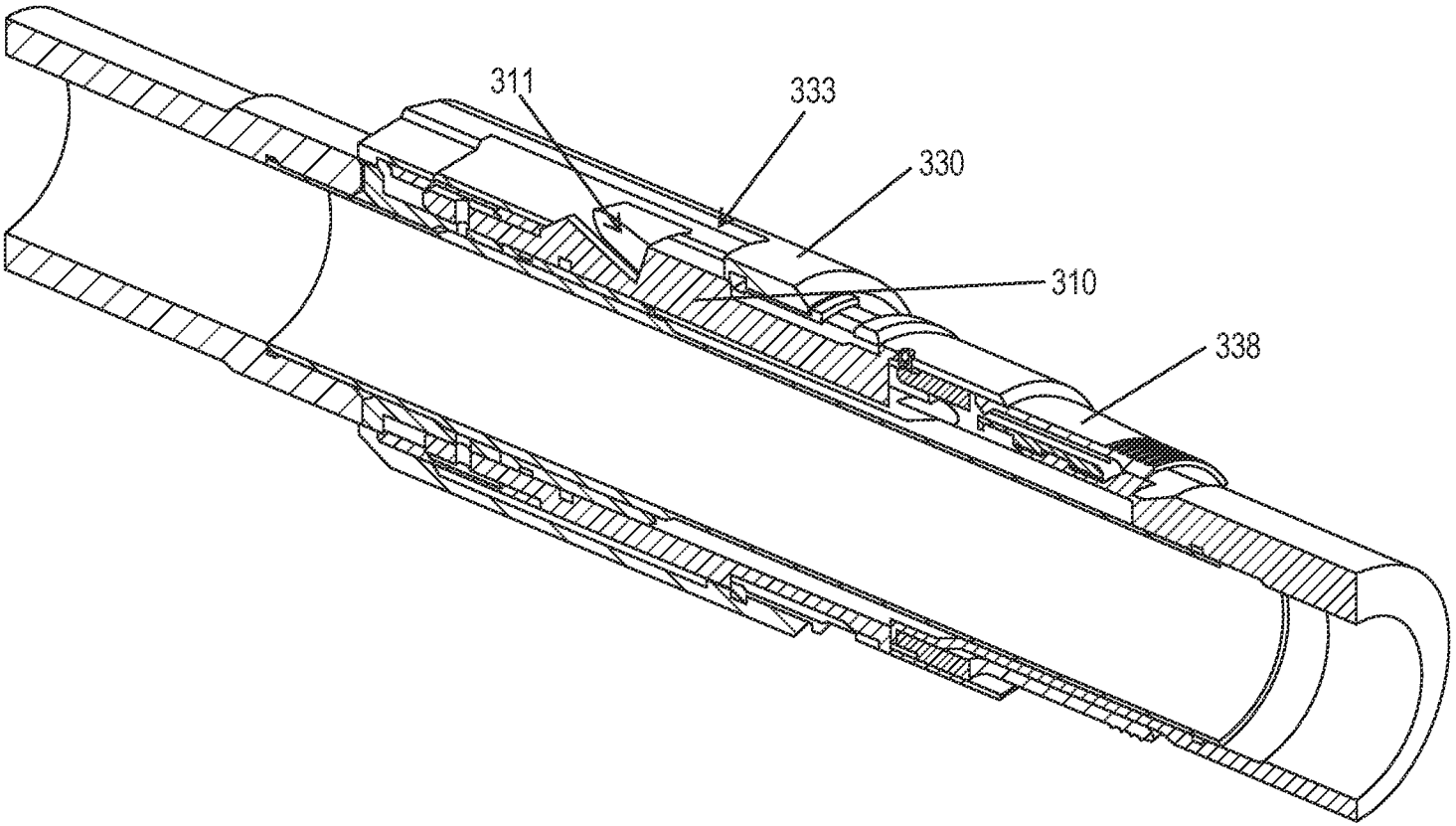
FIG. 6 illustrates a bypass of the example lock latch assembly of FIG. 2.

In some configurations, the lock latch assembly 300 can allow for bypass of control lines if necessary (e.g., when used in combination with a wetmate system), for example as shown in FIG. 6. The sliding collar 330 can include a window 333 (for example, a window milled out of the sliding collar), and the body 310 can include a hole 311. The hole 311 can be drilled or formed at an angle to allow one or more control lines to bypass. The control line(s) can then bend or curve to extend along the mandrel 320 and emerge below an end of the locking collet 338.

Figure 7:
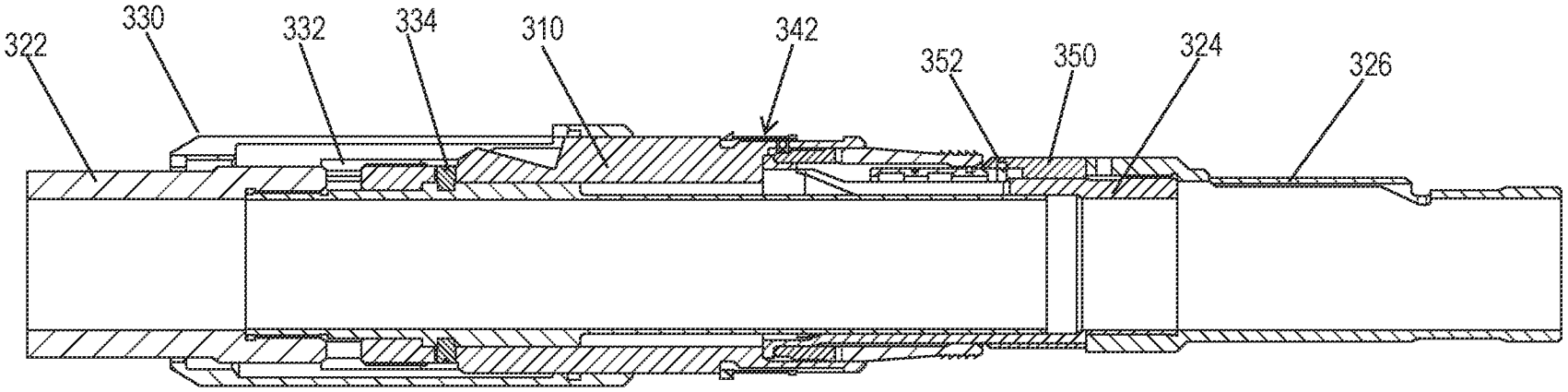
FIG. 7 illustrates an example lock latch assembly.

FIG. 7 illustrates another example latch assembly 300. The latch assembly 300 of FIG. 7 includes many of the features, and functions generally similarly to, the latch 300 of FIGS. 2-6. FIG. 7 shows a bottom sub 326 coupled to the slotted sub 324. As shown, an upper portion of the bottom sub 326 can be circumferentially disposed about a bottom portion of the slotted sub 324.

The latch 300 of FIG. 7 includes a retainer 350 disposed radially or circumferentially about the slotted sub 324. The retainer 350 can be disposed at least partially axially between the bottom sub 326 and the sliding cage 336. The retainer 350 includes a shear tooth, snap ring, or collet 352.

FIGS. 8-12 illustrate stages of operation of the latch of FIG. 7. FIGS. 13-23 illustrate operation of a latch similar to that of FIG. 7, also showing the packer 102 and load paths through the latch 300 during various stages of operation. Similar to the operation of the latch of FIGS. 2-6, during run-in-hole, the activation collet 342 holds the sliding collar 330 in place. The sliding collar 330 holds the tab of the preventer collet 332 axially between the top sub 322 and the main housing 310. The preventer collet 332 and shear screws 334 hold the latch 300 in the position shown in FIG. 8 during run in hole.

Figure 8:
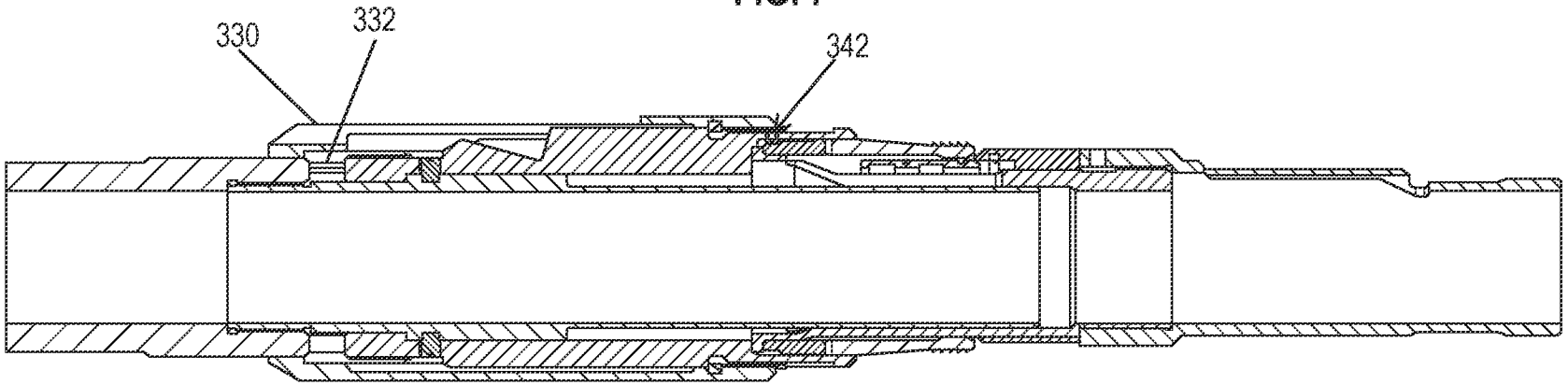
FIG. 8 illustrates the lock latch assembly of FIG. 7 during run-in-hole.
Figure 9:
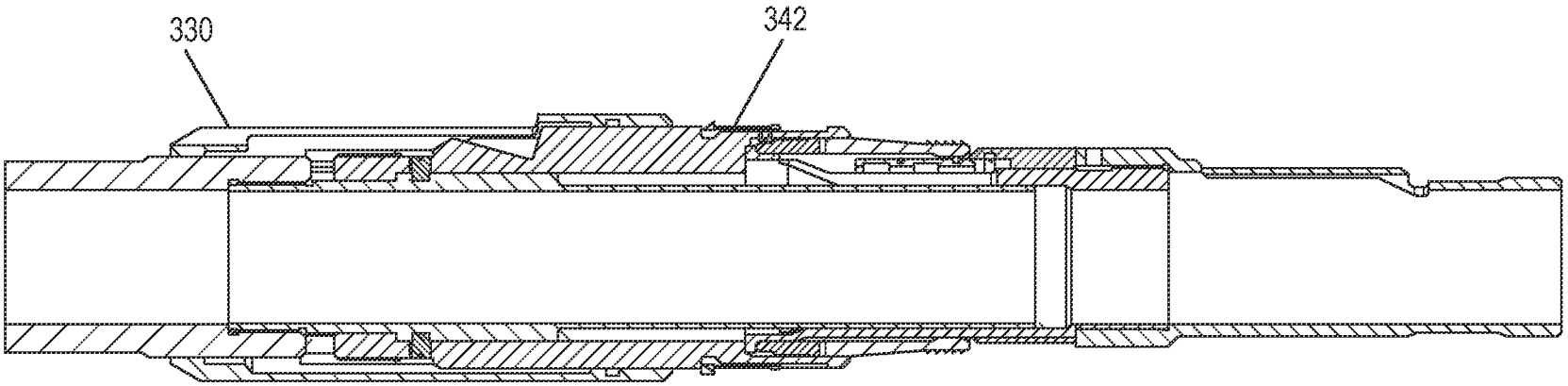
FIG. 9 illustrates the lock latch assembly of FIG. 7 when stabbed into a packer.
Figure 13:
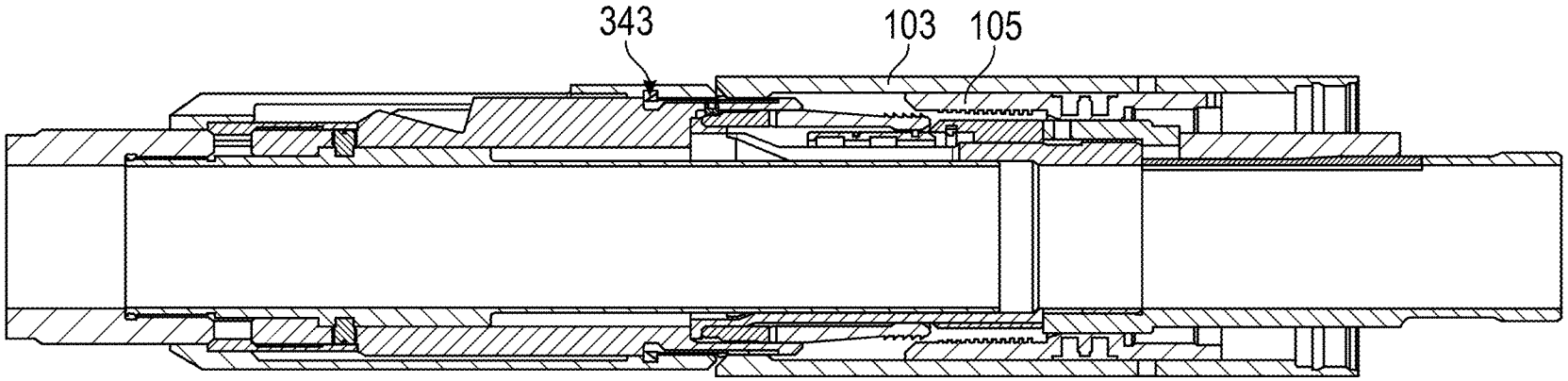
FIG. 13 illustrates a variation of the lock latch assembly of FIG. 7 contacting a packer.
Figure 14A:
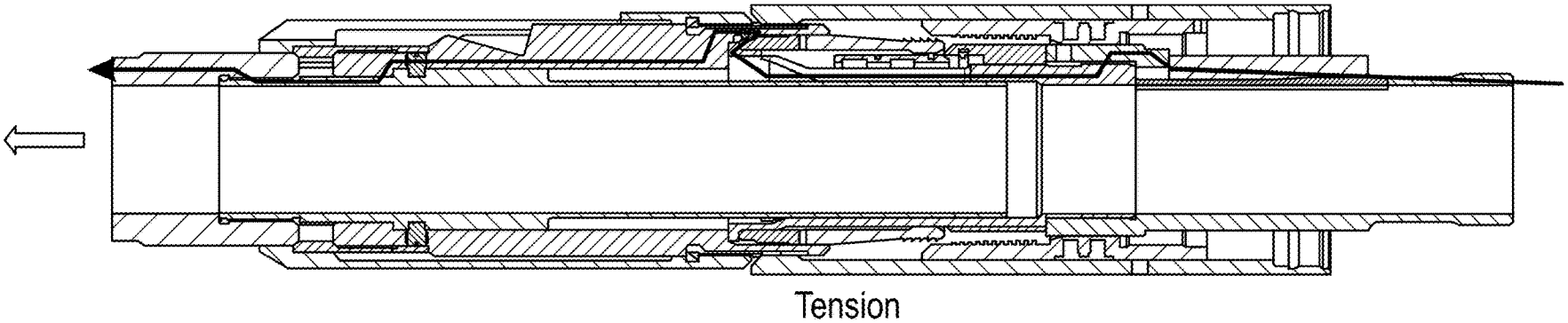
FIGS. 14A and 14B show load paths through the lock latch assembly of FIG. 13 during tension and compression, respectively, when in the run-in-hole position of FIG. 13.
Figure 14B:
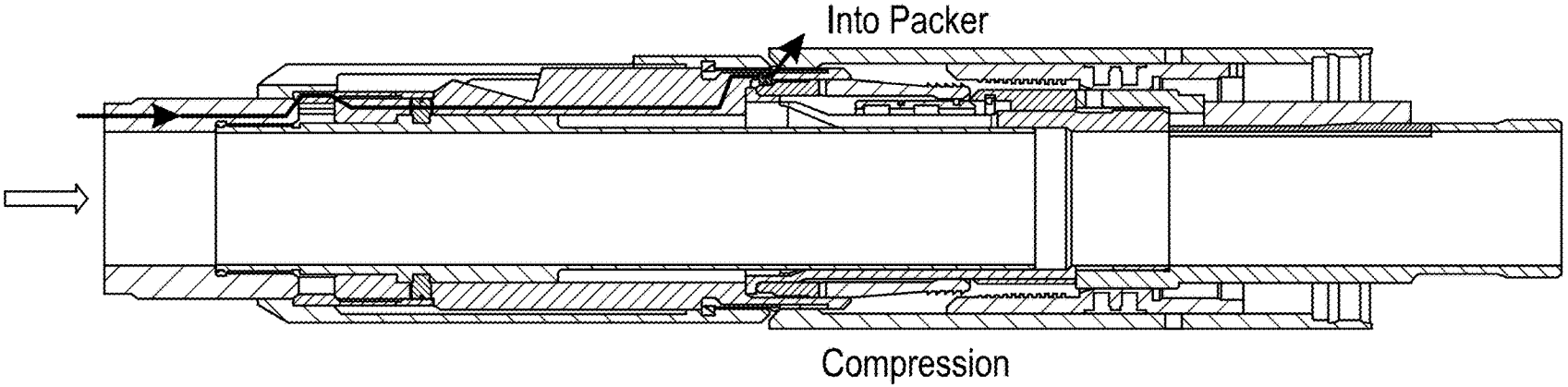
Figure 15:
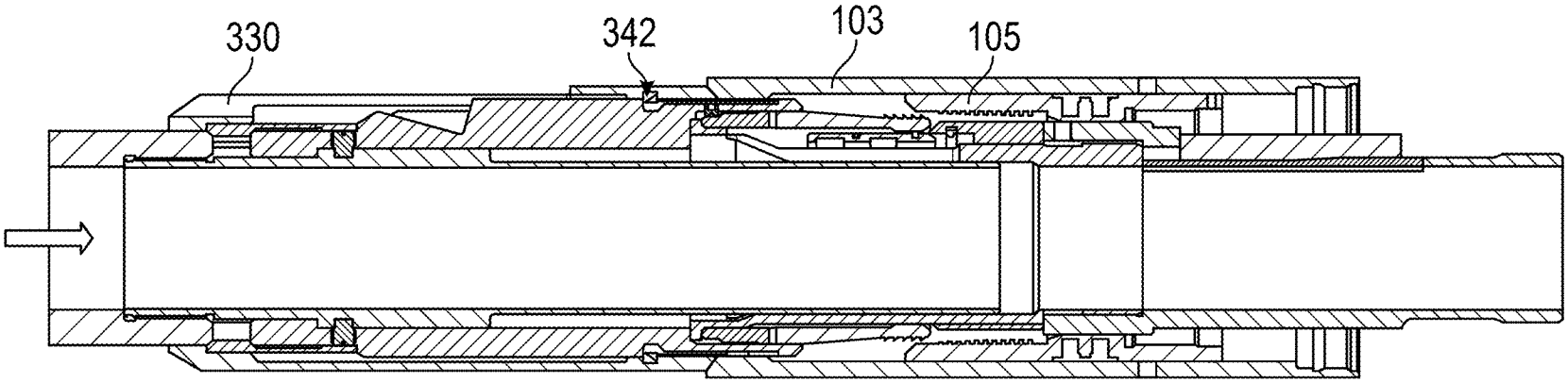
FIG. 15 illustrates the lock latch assembly of FIG. 13 under a small compressive force.
Figure 16A:
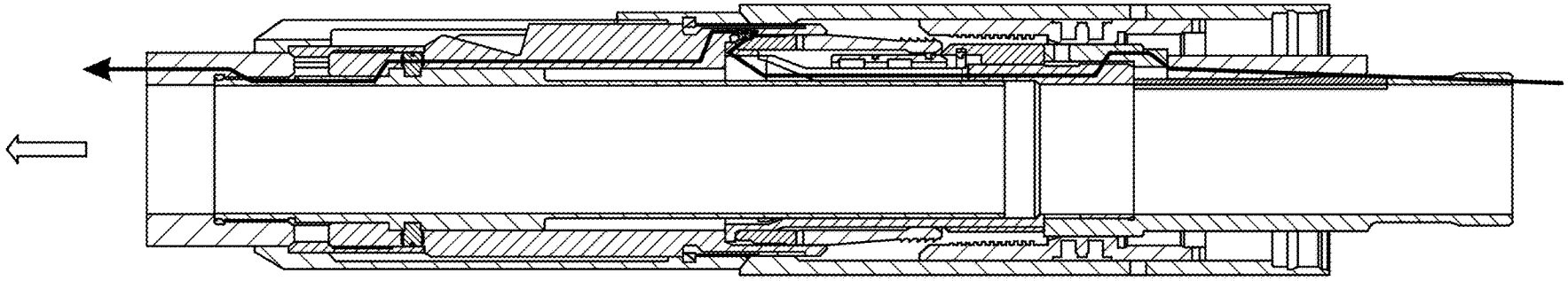
FIGS. 16A and 16B show load paths through the lock latch assembly of FIG. 13 during tension and compression, respectively, when under the compressive force of FIG. 15.
Figure 16B:
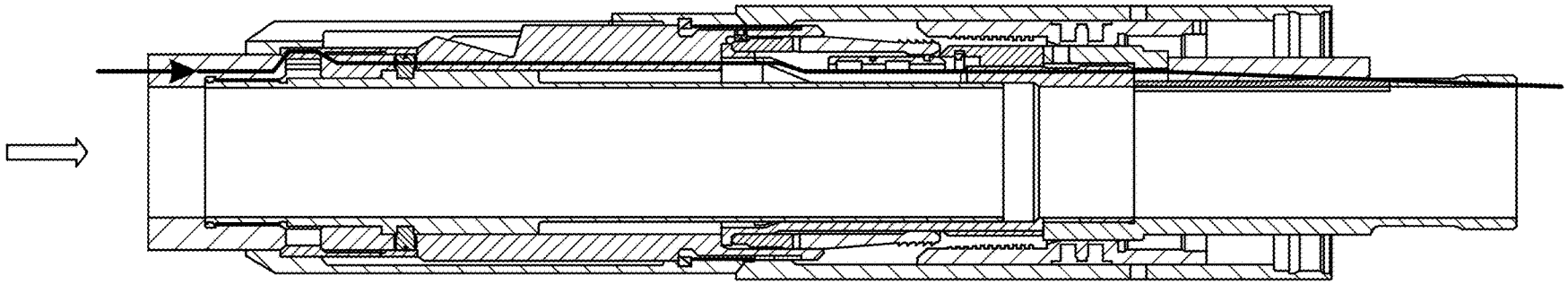
Figure 17:
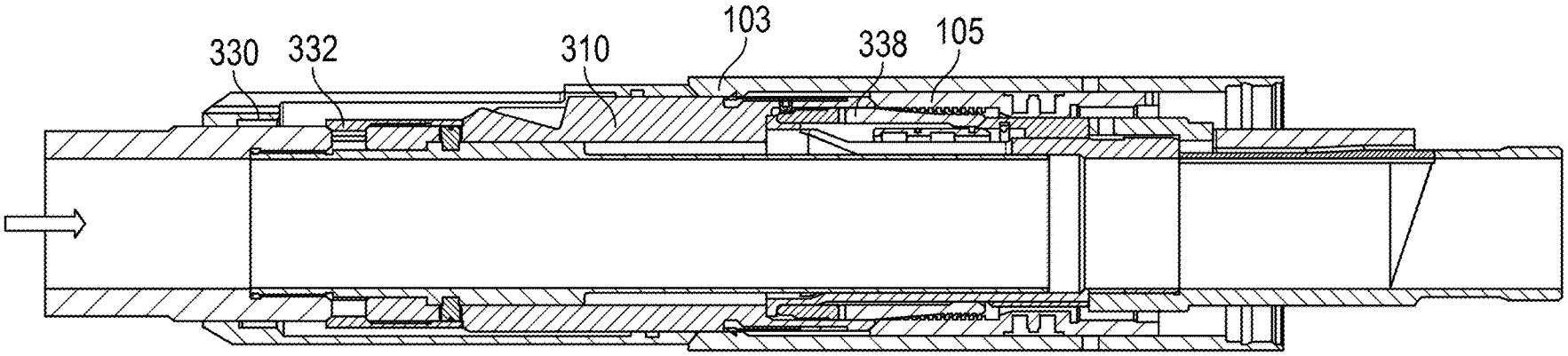
FIG. 17 shows the lock latch assembly of FIG. 13 in a stabbed-in position.
Figure 18A:
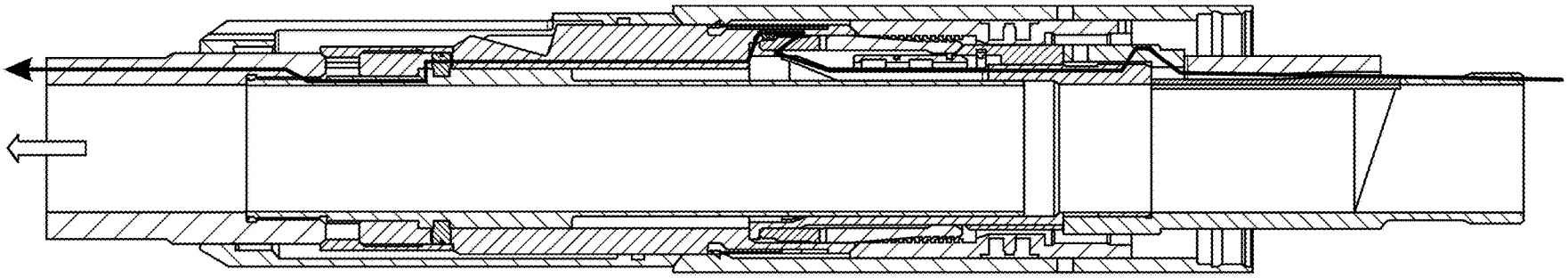
FIGS. 18A and 18B show load paths through the lock latch assembly of FIG. 13 during tension and compression, respectively, when in the stabbed-in position of FIG. 17.
Figure 18B:
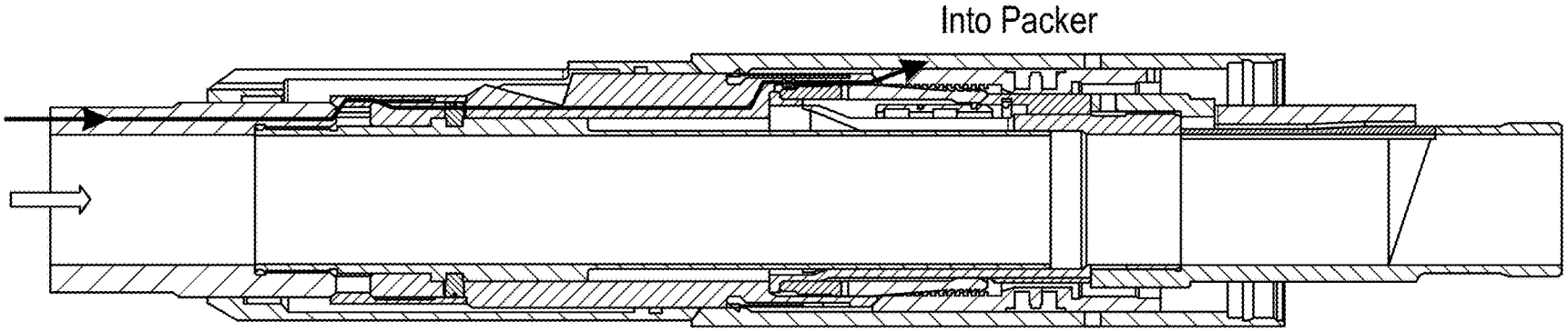

FIG. 13 illustrates initial contact of the latch, in the position of FIG. 8, with the packer 102. FIG. 14 illustrates load paths during tension (FIG. 14A) in which the latch can lift out, and compression (FIG. 14B) on the latch 300 at this stage. A small amount of compression (e.g., about or less than 5 kips) allows the packer sleeve 103 to disengage the activation collet 342 from the sliding collar 330, as shown in FIG. 15. As indicated by the load paths of FIG. 16, tension (FIG. 16A) will lift the latch out, and light compression (FIG. 16B) will cause the latch to stab in. Continued light compression causes the sliding collar 330 to move upward and the main housing 310 to contact the top sub 105 of the packer 102 to achieve stab-in, as shown in FIGS. 9 and 17. The latch 300 now functions as a snap latch. As shown in the load paths of FIG. 18, tension (FIG. 18A) can snap the latch out, depending on the tension applied, and compression forces can be transferred into the packer 102 (FIG. 18B).

Figure 10:
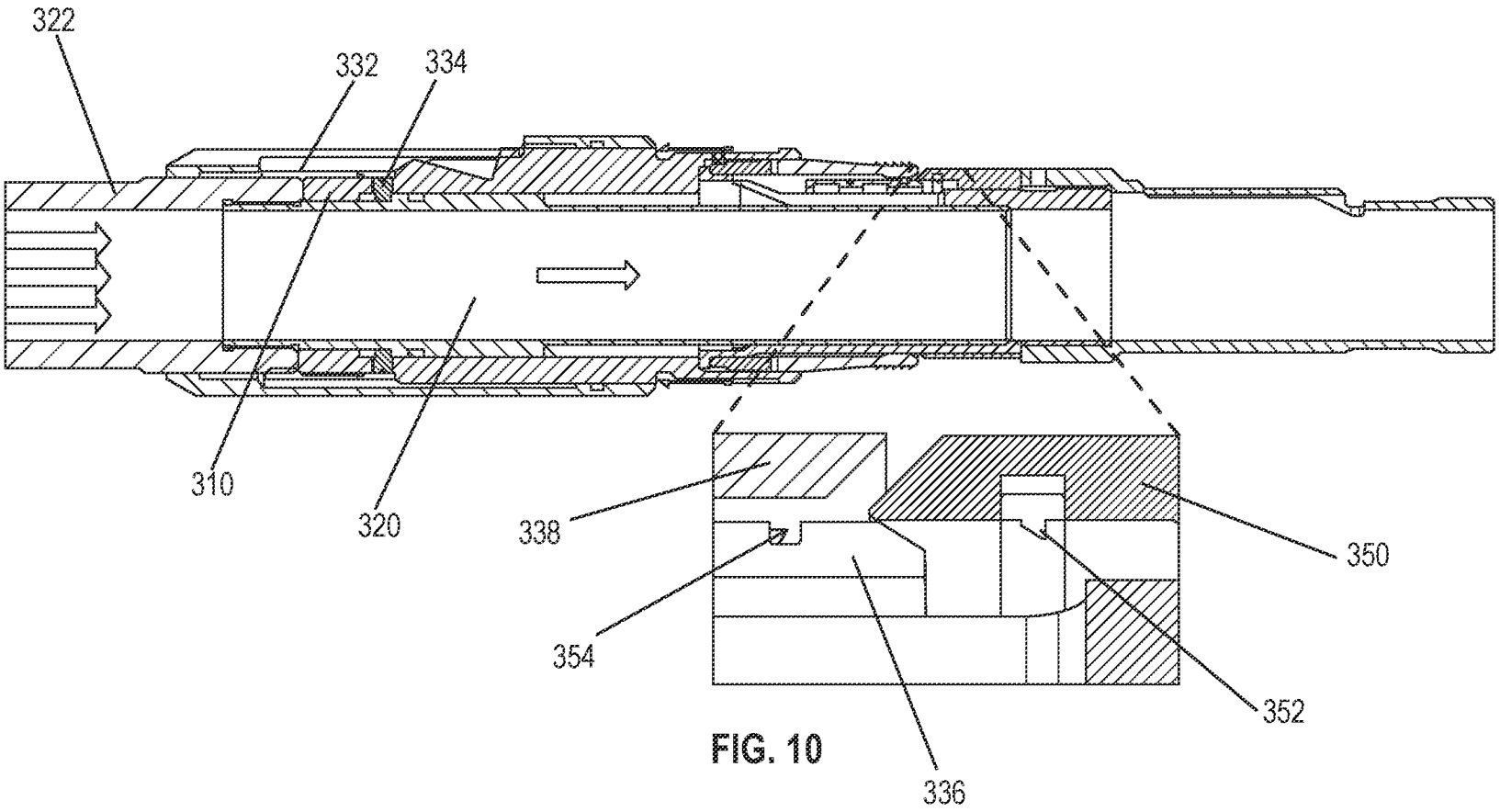
FIG. 10 illustrates the lock latch assembly of FIG. 7 during setting.
Figure 19:
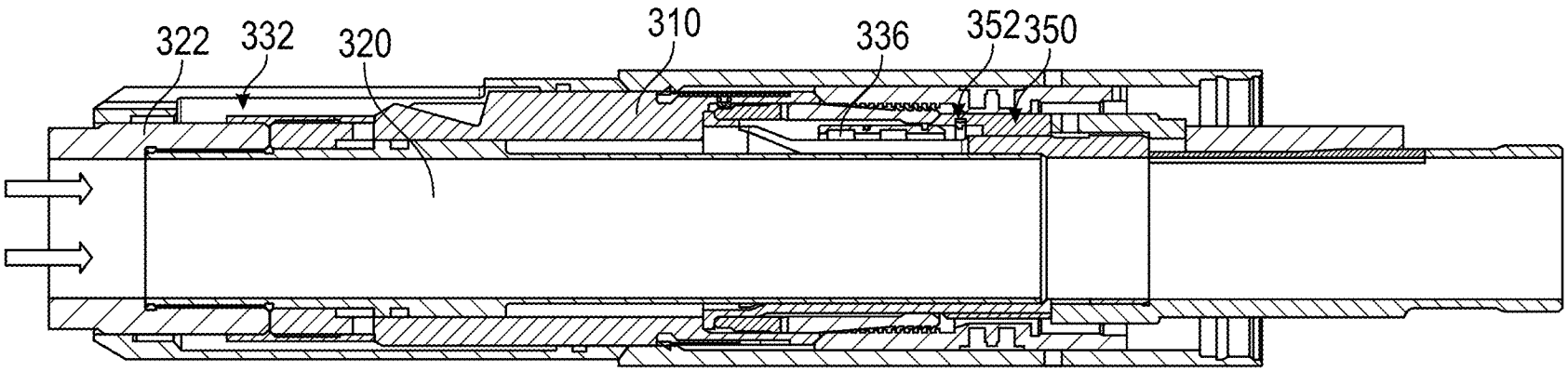
FIG. 19 illustrates the lock latch assembly of FIG. 13 under a larger compressive force to achieve an activated position.
Figure 20A:
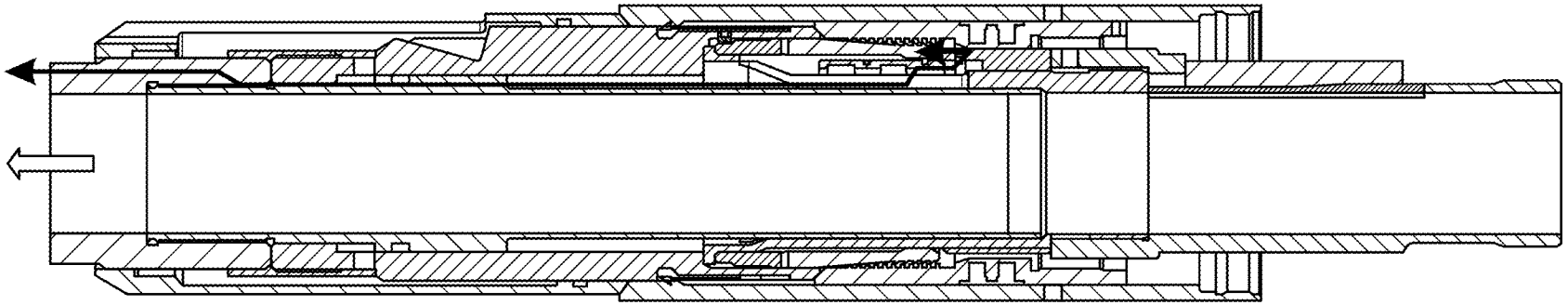
FIGS. 20A and 20B show load paths through the lock latch assembly of FIG. 13 during tension and compression, respectively, when in the activated position of FIG. 19.
Figure 20B:
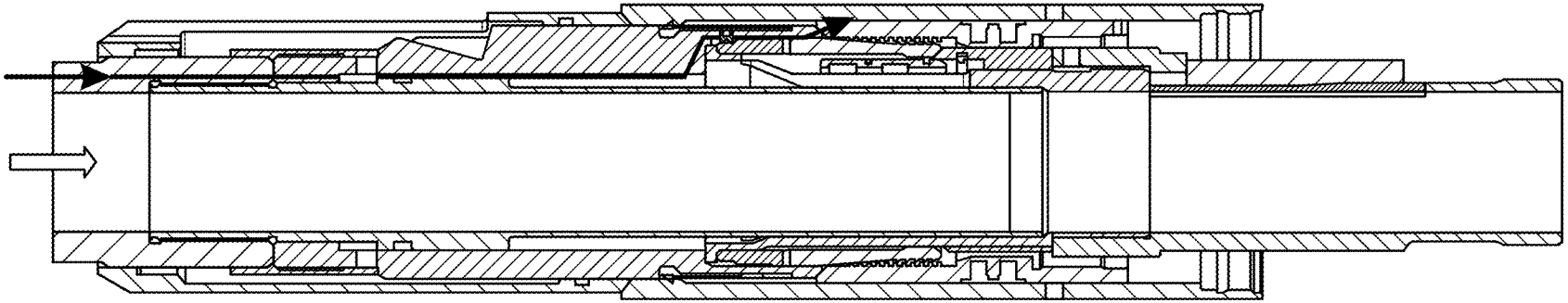

As shown in FIGS. 10 and 19, increased compression, for example, greater than 5 kips, can cause the preventer collet 332 to flex outward. The compression force is therefore transferred to the shear screws 334. At increased compression, for example about or above 30 kips, the shear screws 334 shear, and the top sub 322 and mandrel 320 move downward relative to the main housing 310. As the mandrel 320 moves down (or to the right in the orientation of the figures), the sliding cage 336 moves with the mandrel 320.

A lower portion of the sliding cage 336 slides under, or radially inward of, an upper portion of the retainer 350. As the sliding cage 336 slides under the retainer 350, the shear tooth or snap ring 352 snaps into a corresponding groove 354 in the radially outward side of the sliding cage 336. The engagement of the tooth or snap ring 352 with the groove 354 can help hold the sliding cage 336 in position relative to the retainer 350 and locking collet 338 to maintain the sliding cage's 336 support of the locking collet 338 and hold the teeth of the locking collet 338 in engagement with the corresponding teeth of the packer 102.

Figure 11:
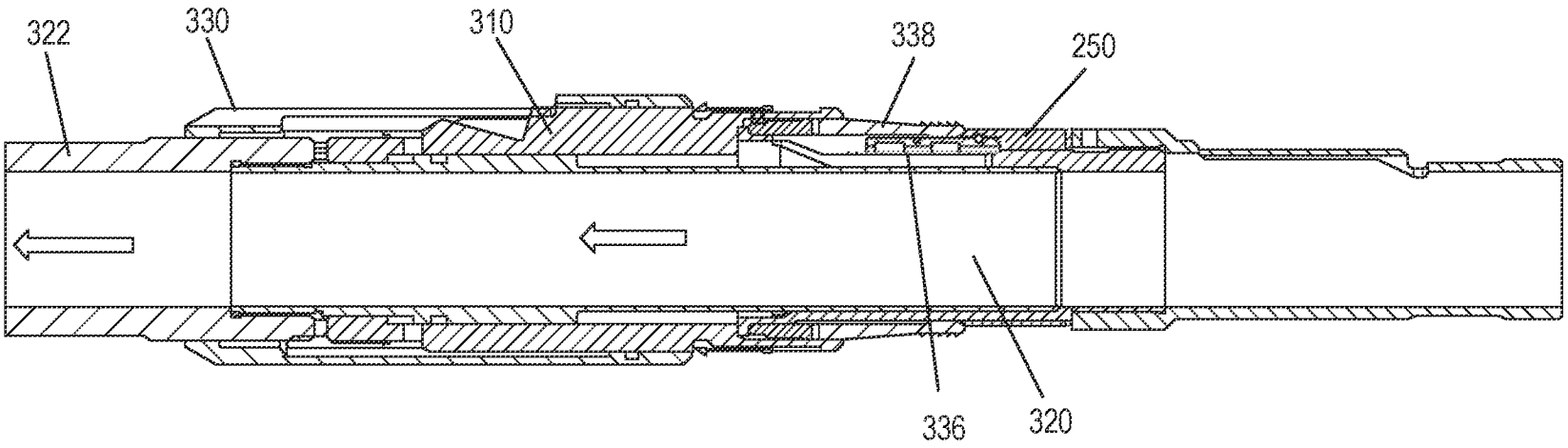
FIG. 11 illustrates the lock latch assembly of FIG. 7 when set.

In some configurations, for example as shown in FIG. 11, a light upward tension on the latch, for example about 10 kips, can set the latch. A portion of the packer, for example a top sub or upper sub 105, includes female teeth, grooves, or threads 107. The teeth 340 of the locking collet 338 latch into the female teeth grooves 107 of the packer 102, creating a shear force to hold the latch 300 in place. An upward or leftward movement of the latch ensures the teeth 340 of the locking collet 338 are engaged with the grooves 107 in the packer 102. As the sliding cage 336 is engaged with the retainer 250, an upward tension on and movement of the top sub 322, mandrel 320, and sliding cage 336 translates to or causes an upward movement of the retainer 250. The retainer 250 shoulders against the locking or main collet 338. Holding tension maintains support to hold the teeth 340 in engagement with the grooves 107, and the latch 300 is now set.

Figure 21A:
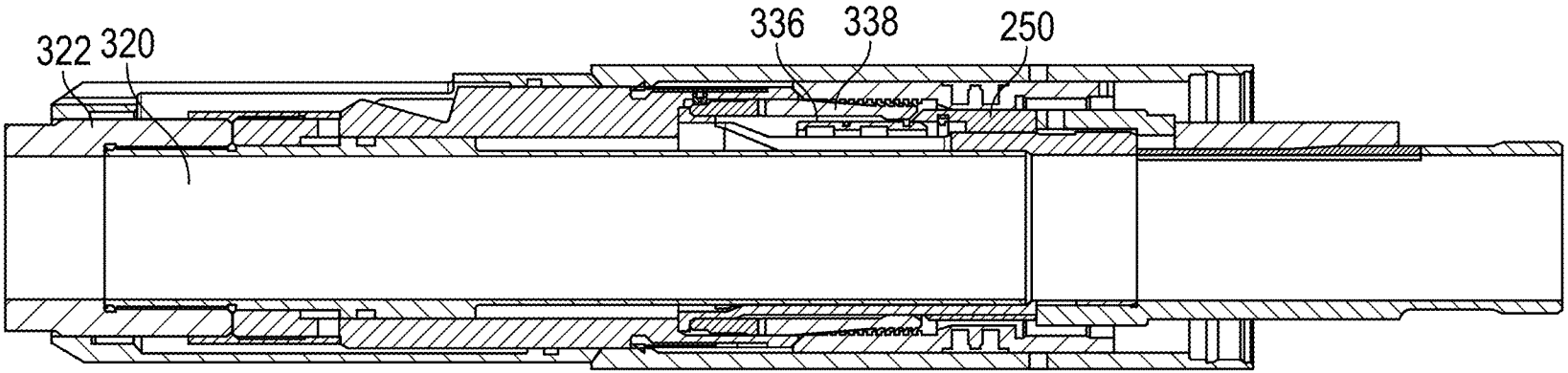
FIGS. 21A-21D show the lock latch assembly in the activated position of FIG. 19 under various force scenarios.
Figure 21B:
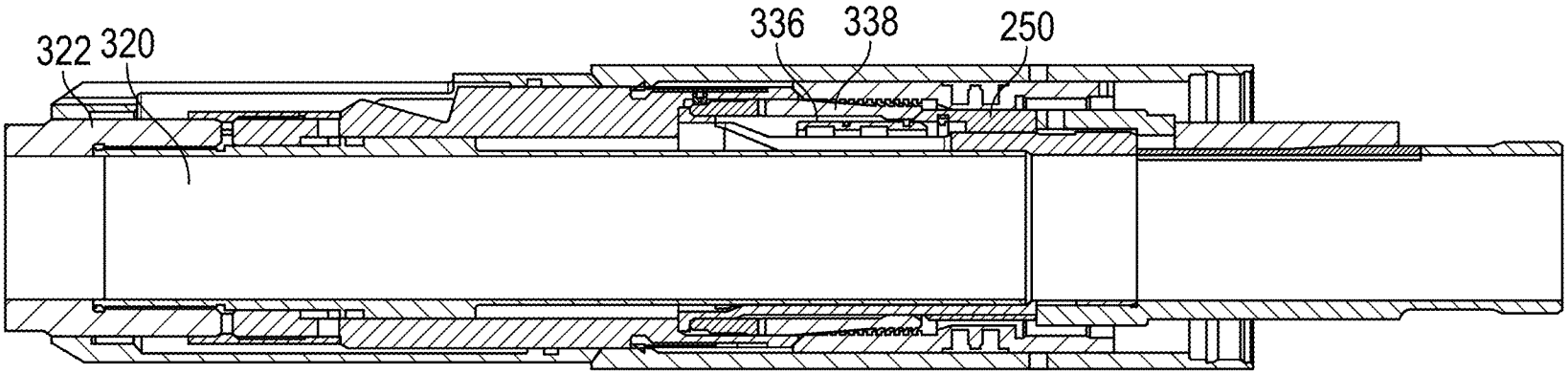
Figure 21C:
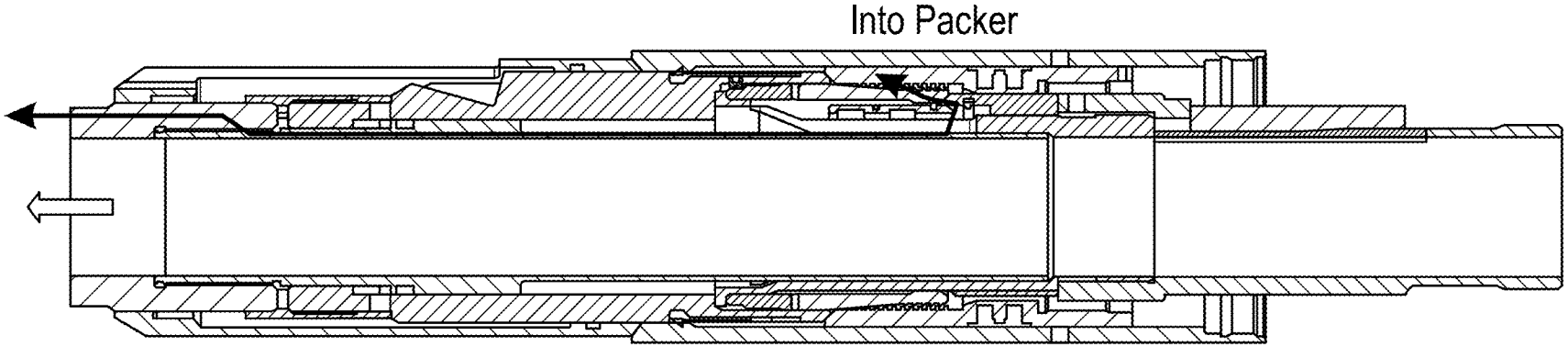
Figure 21D:
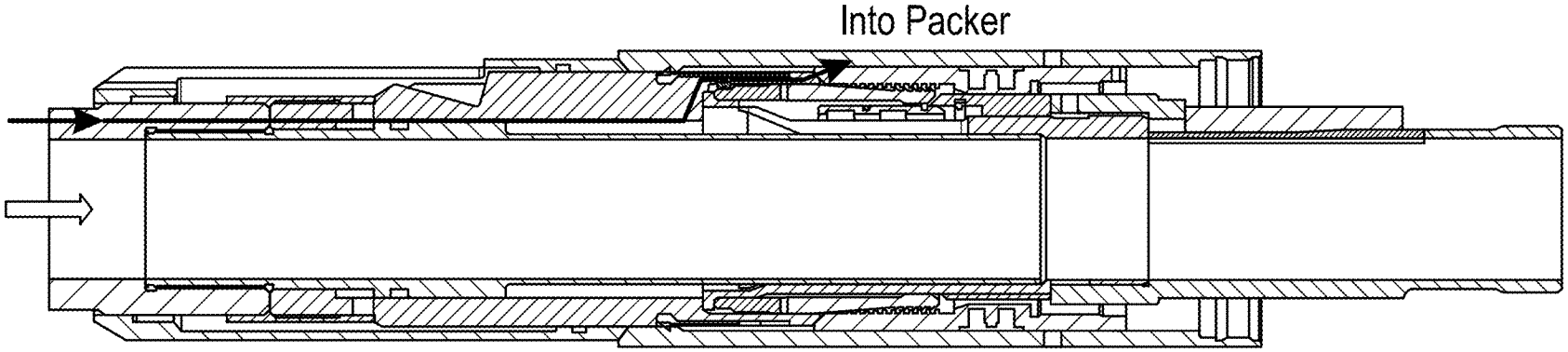

The latch 300 is now in an activated position and is ready to function as a shear latch. As shown in the load paths of FIG. 20, tension (FIG. 20A) causes free moving to slide upwards, and compression (FIG. 20B) is transferred into the packer 102. FIGS. 21A-21D illustrate various force scenarios applied to the latch in this activated position. The latch is snapped in and firmly in place, as shown in FIG. 21A, if 1. No forces are applied; 2. Force is applied from below (e.g., by a water hammer, etc.) to a degree less than the snap-out force (e.g., a force up less than 35 kips if the snap-out force of the locking collet 338 is 35 kips); or 3. Compression is applied from above (also shown in FIG. 21D). FIGS. 21B-21C illustrate a scenario in which tension of up to and less than a release force (e.g., up to and less than about 90 kips or about 110 kips) is applied. The top sub 322, mandrel 320, sliding cage 336, and retainer 250 slide upward. The retainer 250 contacts the locking collet 338 and the locking collet 338 is pushed up as needed to fully engage the teeth 340 of the locking collet 338 with the grooves 107 of the packer 102 as described herein. Further tension supports the locking collet 338.

Figure 12:
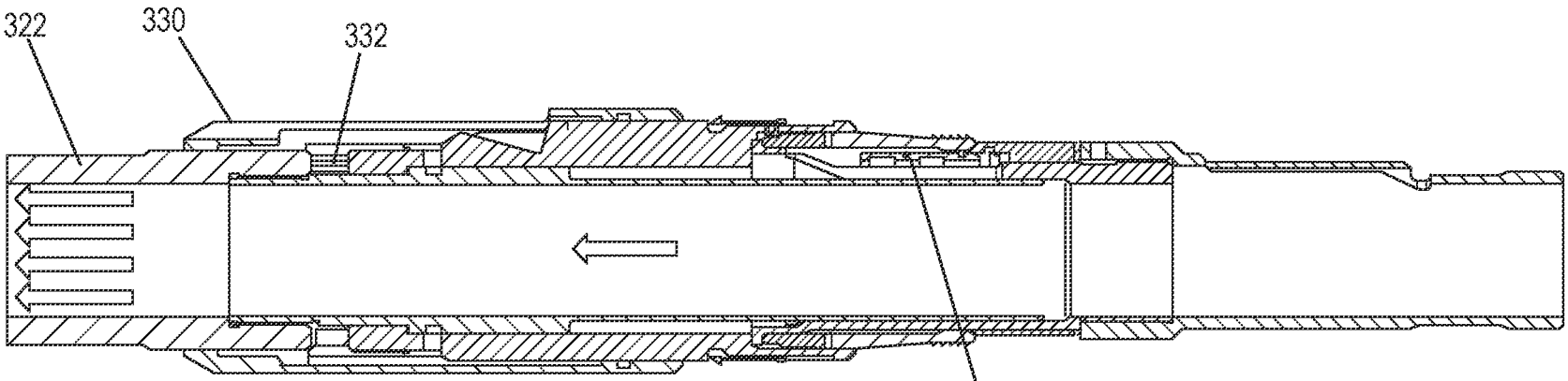
FIG. 12 illustrates release of the lock latch assembly of FIG. 7.
Figure 22:
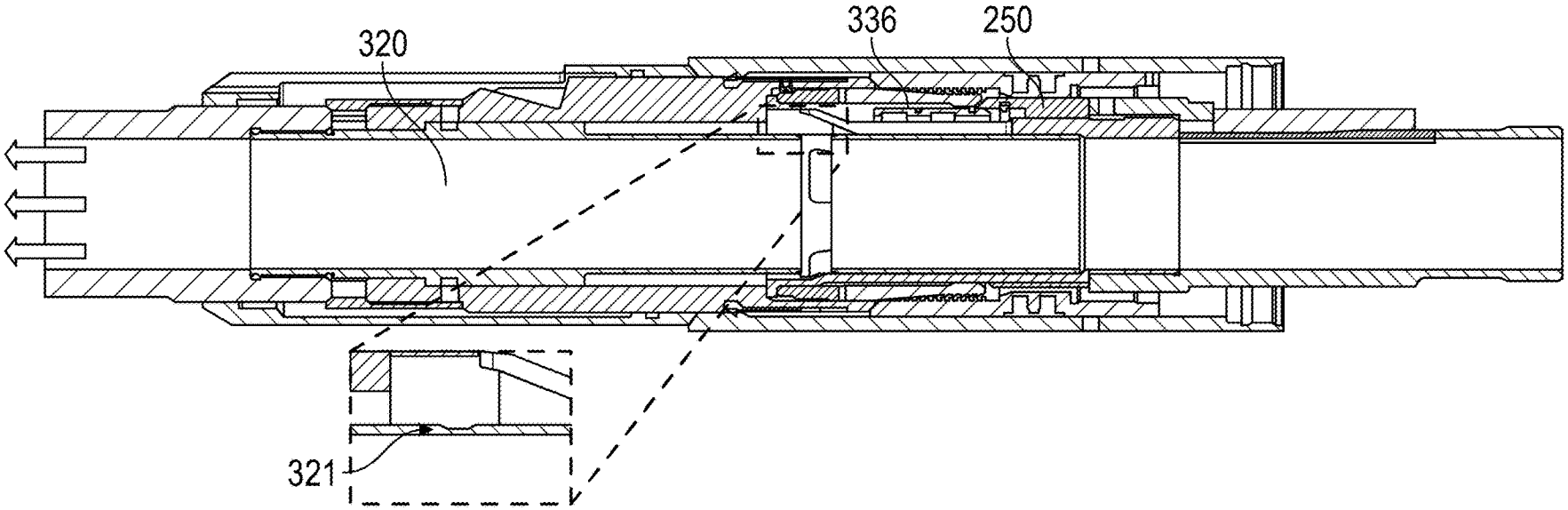
FIG. 22 illustrates the lock latch assembly of FIG. 13 under a tension force to achieve a release position.
Figure 23:
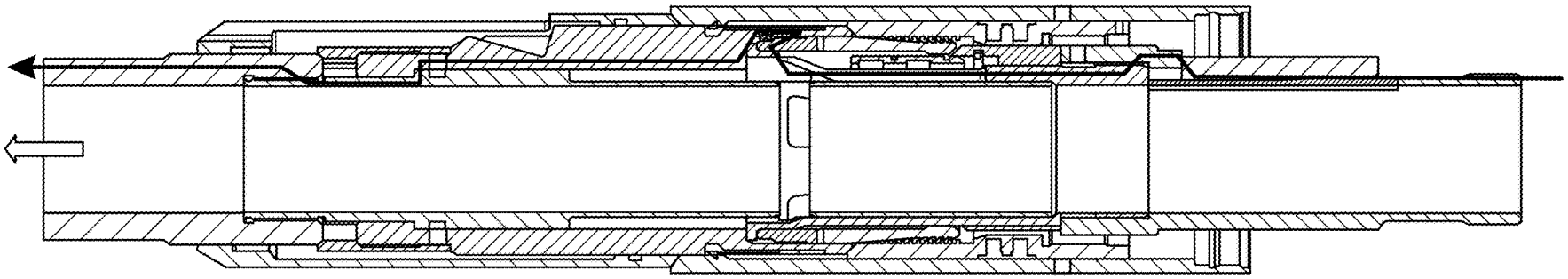
FIG. 23 shows a load path through the lock latch assembly when lifting the lock latch assembly of FIG. 13 out of the hole from the release position of FIG. 22.

To release the latch, a greater upward tension is applied, for example about or greater than 90 or 110 kips, as shown in FIGS. 12 and 22, which illustrate release positions of the latch 300. In some configurations, application of a large tension shears the shear tooth 352, for example as shown in FIG. 12. Once sheared, large tension is no longer required. A minimal tension can then move the mandrel 320 upward or to the left. Movement of the mandrel 320 moves the sliding cage 336, which is no longer engaged with the retainer 250. The locking collet 338 is therefore no longer supported, and the teeth 340 are not held in engagement with the grooves 107. As shown, an outer shoulder of the mandrel 320 may shoulder against an inner shoulder of the main housing 310. A minimal tension can then be used to lift the entire latch 300 out.

In the configuration of FIGS. 13-22, instead of the shear tooth 352, the mandrel 320 shears at a weakened cross-section area 321, as shown in FIG. 22. If the mandrel 320 shears, the shear tooth 352 can be replaced with a ring or collet. The sliding cage 336, retainer 250, and separated parts of the mandrel 320 are then free floating but supported. A tension at the level of the snap-out force (e.g., about 35 kips) or a tension adequate to carry the latch 300 plus tailweight, whichever is higher, can lift the entire latch out, as shown by the load path of FIG. 23. As illustrated by FIGS. 14A-14B, 16A-16B, 18A-18B, 20A-20B, and 23, the load path is designed to avoid the weakened area 321 during run-in-hole to avoid premature shearing of the mandrel 320. After release and shearing of the mandrel 320, the load path is designed to allow everything below the shear to be lifted out.

As described herein, latches 300 according to the present disclosure advantageously act as a snap latch prior to activation, and a shear latch after activation. As the latch 300 contacts the packer 102, stab-in is accomplished with a small amount of compression (e.g., up to 5 kips). This small amount of compression allows for release of the sliding collar 330, allowing the sliding collar 330 to move upward and corresponding engagement features of the latch 300 and packer 102 to snap in. The latch 300 can then act as a snap latch. Increased compression (e.g., about 30 kips) moves the latch 300 to its activated position. The increased compression moves the top sub 322 into contact with the main housing 310, flexing the preventer collet 332 outwards, and shears the shear screws 334. The mandrel 320 and sliding cage 336 move downward with the top sub 322 such that the sliding cage 336 slides at least partially under the locking collet 338 to support the locking collet 338 and hold the teeth of the latch 300 in engagement with the teeth of the packer 102. In some configurations, such as the configuration of FIG. 7, the retainer 350 engages the sliding cage 336 to maintain the position of the sliding cage 336 to support the locking collet 338. The latch 300 then acts as a shear latch. A sufficient tension (e.g., about or greater than 90 kips) allows for release of the latch 300. The sufficient tension can shear a shear element or component of the latch to allow the latch to move to a release position. A reduced tension can then be applied to lift the latch 300 out of hole.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A lock latch assembly comprising:

a body;

a mandrel disposed circumferentially within the body;

a top sub coupled to an upper end of the mandrel;

a sliding collar disposed about a portion of the body and a portion of the top sub;

a locking collet disposed circumferentially within a portion of the body;

a sliding cage disposed circumferentially within the locking collet;

one or more shear screws extending radially through the body; and a preventer collet disposed about a portion of the body and comprising a tab portion disposed axially between the top sub and the body when the lock latch assembly is in a run-in-hole position.

2. The lock latch assembly of claim 1, further comprising an activation collet disposed about a portion of the body.

3. The lock latch assembly of claim 1, wherein the lock latch assembly is configured to allow for bypass of control lines.

4. A method of locking the lock latch assembly of claim 1, the method comprising:

shouldering the sliding collar with a topmost face of a packer disposed in a wellbore; and applying a downward or compressive force, thereby causing the sliding collar to move upwards and the locking collet to contact the packer.

5. The method of claim 4, further comprising activating the lock inside the packer.

6. The method of claim 5, wherein activating the lock comprises:

applying a high compressive force;

shearing the shear screws; and sliding the sliding cage under the locking collet to maintain the locking collet in engagement with the packer.

7. The method of claim 6, further comprising releasing the lock latch assembly by applying a high tension force.

8. The method of claim 7, wherein releasing the lock latch assembly comprises:

pulling the mandrel upward, thereby sliding the sliding cage upwards; and allowing the locking collet to deflect out of engagement with the packer.

9. A latch assembly comprising:

a main housing;

a mandrel disposed at least partially circumferentially within the main housing;

a top sub coupled to an upper end of the mandrel;

a sliding collar disposed circumferentially about the top sub and the main housing;

a slotted sub disposed circumferentially about a lower portion of the mandrel;

a sliding cage disposed radially outward of the slotted sub and coupled to the mandrel;

a retainer disposed circumferentially about the slotted sub; and a locking collet disposed circumferentially about the slotted sub, an outer surface of the locking collet comprising teeth configured to engage corresponding grooves in a packer.

10. The latch assembly of claim 9, wherein the retainer comprises an engagement feature and the sliding cage comprises a groove, wherein during installation of the latch assembly, a compressive force on a latch causes the top sub, the mandrel, and the sliding cage to move downward until the engagement feature snaps into the groove of the sliding cage.

11. The latch assembly of claim 10, wherein a light tension on the latch ensures engagement of the teeth of the locking collet with the grooves in the packer.

12. The latch assembly of claim 11, wherein the engagement feature is configured to be sheared by a large tension on the latch to release the latch and allow the latch to be removed.

13. The latch assembly of claim 9, further comprising a hole formed in the main housing and configured to allow one or more control lines to extend through the latch assembly.

* * * * *